US006911067B2

(12) United States Patent
Kolics et al.

(10) Patent No.: US 6,911,067 B2
(45) Date of Patent: Jun. 28, 2005

(54) SOLUTION COMPOSITION AND METHOD FOR ELECTROLESS DEPOSITION OF COATINGS FREE OF ALKALI METALS

(75) Inventors: Artur Kolics, San Jose, CA (US); Nicolai Petrov, Santa Clara, CA (US); Chiu Ting, Saratoga, CA (US); Igor C. Ivanov, Dublin, CA (US)

(73) Assignee: Blue29, LLC, Sunnyvale, CA (US)

( * ) Notice: Subject to any disclaimer, the term of this patent is extended or adjusted under 35 U.S.C. 154(b) by 68 days.

(21) Appl. No.: 10/339,260

(22) Filed: Jan. 10, 2003

(65) Prior Publication Data

US 2004/0134375 A1 Jul. 15, 2004

(51) Int. Cl.[7] ..... C23C 18/50; C23C 18/52

(52) U.S. Cl. ..... 106/1.22; 106/1.24; 106/1.25; 106/1.27; 106/1.28

(58) Field of Search ..... 106/1.22, 1.24, 106/1.25, 1.27, 1.28

(56) References Cited

U.S. PATENT DOCUMENTS

| | | | | |
|---|---|---|---|---|
| 4,231,813 | A | 11/1980 | Carlin | |
| 5,695,810 | A | 12/1997 | Dubin et al. | |
| 6,165,902 | A | 12/2000 | Pramanick et al. | |
| 6,638,564 | B2 * | 10/2003 | Segawa et al. | 427/8 |
| 6,715,663 | B2 * | 4/2004 | Seshan et al. | 228/103 |
| 6,717,189 | B2 * | 4/2004 | Inoue et al. | 257/200 |
| 2002/0084529 | A1 * | 7/2002 | Dubin et al. | 257/774 |
| 2003/0113576 | A1 * | 6/2003 | Chebiam et al. | 428/670 |
| 2003/0134047 | A1 * | 7/2003 | Dubin et al. | 427/421 |
| 2003/0221612 | A1 * | 12/2003 | Dai et al. | 118/72 |
| 2003/0235658 | A1 * | 12/2003 | Shacham-diamand et al. | 427/437 |

OTHER PUBLICATIONS

Y. Shacham–Diamand, et al. "Electroless Deposition of thin–Film Cobalt–Tungsten–Phosphorus Layers Using Tungsten Phosphoric Acid for ULSI and MEMS Applications", Journal of the Electrochemical Society; 148(3), C162–C167 (2001), no month.

A. Kohn, et al "Characterization of Electroless deposited Co(w,p) thin films for encapsulation of copper Metallization", Materials Science and Engineering, A302, 18–25 (2001), no month.

A. Kohn, et al. "Evaluation of Electroless deposited Co(W, P) thin films as diffusion Barriers for Copper Metallization" Monoelectronic Engineering 55, 297–303 (2001), no month.

Y. Shacham–Diamand, et al. "Electochemically Deposited Thin–Film Alloys for ULSI and MEMS applications" Microelectronic Engineering, 50, 525–531 (2000), no month.

Y. Shacham–Diamand, et al. "The electrical and Material properties of MOS Capacitors with Electrolessly deposited integrated copper gate", Microelectronic Engineering, 55, 313–322 (2001), no month.

Y. Shacham–Diamand, et al, "Integrated electroless metallization of ULSI", Electrochimica Acta 44, 3639–3649, (1999), no month.

Y. Segawa et al. Manufacturing–Ready Selectivity of CoWP Capping on Demascene Copper Interconnects (2001), no month.

* cited by examiner

*Primary Examiner*—Helene Klemanski
(74) *Attorney, Agent, or Firm*—Mollie E. Lettang; Daffer McDaniel, LLP

(57) ABSTRACT

An electroless deposition solution of the invention for forming an alkali-metal-free coating on a substrate comprises a first-metal ion source for producing first-metal ions, a pH adjuster in the form of a hydroxide for adjusting the pH of the solution, a reducing agent, which reduces the first-metal ions into the first metal on the substrate, a complexing agent for keeping the first-metal ions in the solution, and a source of ions of a second element for generation of second-metal ions that improve the corrosion resistance of the aforementioned coating. The method of the invention consists of the following steps: preparing hydroxides of a metal such as Ni and Co by means of a complexing reaction, in which solutions of hydroxides of Ni and Co are obtained by displacing hydroxyl ions $OH^-$ beyond the external boundary of ligands of mono- or polydental complexants; preparing a complex composition based on a tungsten oxide $WO_3$ or a phosphorous tungstic acid, such as $H_3[P(W_3O_{10})_4]$, as well as on the use of tungsten compounds for improving anti-corrosive properties of the deposited films; mixing the aforementioned solutions of salts of Co, Ni, or W and maintaining under a temperatures within the range of 20° C. to 100° C.; and carrying out deposition from the obtained mixed solution.

43 Claims, No Drawings

SOLUTION COMPOSITION AND METHOD FOR ELECTROLESS DEPOSITION OF COATINGS FREE OF ALKALI METALS

FIELD OF THE INVENTION

The present invention relates to the field of electroless plating, in particular to solution compositions and a method for electroless formation of alkali-metal-free coatings on the basis of metals, such as cobalt and nickel and composition of these metals with tungsten and phosphorus, which have high resistance to oxidation. Such coatings may find application in semiconductor manufacturing where properties of deposited films and controllability of the composition and physical and chemical characteristics of the deposited films may be critically important.

BACKGROUND OF THE INVENTION

Copper is increasingly replacing aluminum in interconnects fabrication in ultra-large-scale (ULSI) microelectronic devices. Nevertheless, this technology faces a few problems such as metal corrosion, weak adhesion, high chemical reactivity, and considerable diffusion of copper in silicon. One of the recent approaches to successfully address these issues is the formation of barrier/capping layer by electroless deposition. Thin films of Co(W,P) and Ni(Re,P) prepared by electroless deposition have already been shown to have potential application as barrier/capping layers on copper interconnects. These films provide significantly lower resistivity than other barriers and the formation of very thin, selective, and conformal deposition can be achieved through the electroless deposition.

Several related deposition chemistries shown in Table 1 have been developed and published recently for depositing phosphorous-containing cobalt or nickel-based amorphous barriers.

TABLE 1

| Components and operating conditions | Concentration of components (g/l) | | | | | | | | | |
|---|---|---|---|---|---|---|---|---|---|---|
| | Pat. 3*** | Pat. 2** | Pat. 1* | $4^{3\kappa}$, $5^{4\kappa}$ | $2^{1\kappa}$, $3^{2\kappa}$ | $1^{\lambda}$ | | $8^{\pi}$ | | $9^{\theta}$ |
| Cobalt sulfate heptahydrate | | | | 23 | 23 | 23 | | | | 10–30 |
| Cobalt chloride hexahydrate | 30 | 4 | 30 | | | | 30–60 | 30–60 | 30–60 | |
| Sodium hypophosphite | 20 | 15 | 20 | 21 | 21 | 21 | 10–20 | | | |
| Ammonium hypophosphite | | | | | | | | | | 25–50 |
| $(TMA)H_2PO_2$ | | | | | | | | 10–20 | 10–20 | |
| Sodium tungstate | 10 | 12 | | 0–30 | 0–30 | | 10–30 | | | |
| Ammonium tungstate | | | 10 | | | | | 10–30 | | 10–30 |
| Tungsten phosphoric acid | | | | | | 13.5–70 | | | | |
| $(TMA)_2WO_4$ | | | | | | | | | 10–30 | |
| Boric acid | | | | 31 | 31 | | | | | |
| Sodium citrate | 84.5 | 30 | 80 | 130 | 130 | | 20–80 | | | |
| Ammonium citrate | | | | | | | | | | 25–100 |
| $(TMA)_3C_6H_4O_7$ dihydrate | | | | | | | | 20–80 | 20–80 | |
| Ammonium chloride | 50 | | | | | | | | | |
| Ammonium sulfate | | | | | | | | | | |
| Sodium borate decahydrate | | 4 | | | | | | | | |
| Rhodafac 610 | 0.05 | | 0.05 | 0.05 | 0.05 | 0.05 | 0.5 | 0.5 | 0.5 | |
| pH | 9.5 | 8.3–8.7 | | 7.5–9.0 | 9 | 8.9–9.0 | ?? | ?? | ?? | 8–10 |

TABLE 1-continued

| Components and operating conditions | Concentration of components (g/l) | | | | | | | | | |
|---|---|---|---|---|---|---|---|---|---|---|
| | Pat. 3*** | Pat. 2** | Pat. 1* | $4^{3\kappa}$, $5^{4\kappa}$ | $2^{1\kappa}$, $3^{2\kappa}$ | $1^{\lambda}$ | | $8^{\pi}$ | | $9^{\theta}$ |
| pH adjustment | | | NaOH/KOH | | | | ?? | ?? | ?? | TMAH |
| Temperature/° C. | 95 | 78–87 | | 75–90 | 85–95 | 90–95 | ?? | ?? | ?? | 60–80 |

1* U.S. Pat. No. 5,695,810 December 1997 Dubin et al.
2** U.S. Pat. No. 4,231,813 November 1980 Carlin
3*** U.S. Pat. No. 6,165,902 December 2000 Pramanick et al.
$^{\lambda}$Yosi Shacham-Diamand, Y. Sverdlov, N. Petrov: "Electroless Deposition of Thin-Film Cobalt-Tungsten-Phosphorus Layers Using Tungsten Phosphoric Acid ($H_3[P(W_3O_{10})_4]$) for ULSI and MEMS Applications" Journal of The Electrochemical Society 148 (3), C162–C167 (2001).
$^{1\kappa}$A. Kohn, M. Eizenberg, Y. Shacham-Diamand, Y. Sverdlov: "Characterization of electroless deposited Co (W, P) thin films for encapsulation of copper metallization" Materials Science and Engineering A302, 18–25 (2001).
$^{2\kappa}$A. Kohn, M. Eizenberg, Y. Shacham-Diamand, B. Israel, Y. Sverdlov: "Evaluation of electroless deposited Co (W, P) thin films as diffusion barriers for copper metallization" Microelectronic Engineering 55, 297–303 (2001).
$^{3\kappa}$Y. Shacham-Diamand, Y. Sverdlov: "Electrochemically deposited thin film alloys for ULSI and MEMS applications" Microelectronic Engineering 50, 525–531 (2000).
$^{4\kappa}$Yosi Shacham-Diamand, Barak Israel, Yelena Sverdlov: "The electrical and material properties of MOS capacitors with electrolessly deposited integrated copper gate" Microelectronic Engineering 55, 313–322 (2001).
$^{\pi}$Yosi Shacham-Diamand, Sergey Lopatin: "Integrated electroless metallization for ULSI" Electrochimica Acta 44, 3639–3649 (1999).
$^{\theta}$Y. Segawa, H. Horikoshi, H. Ohtorii, K. Tai, N. Komai, S. Sato, S. Takahashi, Y. Ohoka, Z. Yasuda, M. Ishihara, A. Yoshio, T. Nogami: "Manufacturing-ready Selectivity of CoWP Capping on Damascene Copper Interconnects" (2001)

A common disadvantage of all known compositions and processes mentioned in Table 1 is that films deposited from the solutions of the aforementioned compounds contains alkali-metal i.e., of Na and K in various alkali metals in concentrations significantly exceeding $2\times10^{-4}$ atomic % (2 ppm). It is well known, however, that high concentrations of Na and K, which have high mobility, is unacceptable for functional layers of semiconductor wafers used in the manufacture of semiconductor devices. More specifically, the detrimental effect of alkali metals is primarily related to their easy penetration into silicon dioxide and microelectronic components.

Other drawbacks of some of the known solution compositions and processes listed in Table 1 are the following: an increased amount of highly-volatile, contaminating, and toxic components in an electroless deposition solution; relatively noticeable toxicity of some compositions; insufficient anti-corrosive properties of the deposited films; increased amount of ions of precipitation metals with a high degree of oxidation; and non-optimal concentrations of complexing agents required for obtaining deposited films with desired properties.

SUMMARY OF THE INVENTION

It is an object of the invention to provide an alkali-metal-free solution for electroless deposition. Another object is to form smooth coating films which are free of alkali-metal components. A further object is to provide aforementioned coating films suitable for formation of barrier/capping layers on semiconductor substrates. Another object is to provide a method for forming alkali-metal-free coating films and for manufacturing IC devices at a reduced cost. It is another object to reduce the amount of highly-volatile, contaminating, and toxic components in an electroless deposition solution. It is a further object to provide the aforementioned solution with reduced toxicity. Still another object is improve anti-corrosive properties of the deposited films. Another object is to minimize the amount of ions of precipitation metals with a high degree of oxidation. A further object is to exclude or minimize the use of solutions, which have a tendency to the formation of gels and various other colloidal aggregates that may impair properties of deposited metal films. Still another object of the invention is to use complexing agents in optimal concentrations which improve quality of the deposited films.

An electroless deposition solution of the invention for forming an alkali-metal-free coating on a substrate comprises a first-metal ion source for producing first-metal ions, a pH adjuster in the form of a hydroxide for adjusting the pH of the solution, a reducing agent, which reduces the first-metal ions into the first metal on the substrate, a complexing agent for keeping the first-metal ions in the solution, and a source of ions of a second element for generation of second-metal ions that improve the corrosion resistance of the aforementioned coating.

The method of the invention consists of the following steps: preparing hydroxides of a metal such as Ni and Co by means of a complexing reaction, in which solutions of hydroxides of Ni and Co are obtained by displacing hydroxyl ions $OH^-$ beyond the external boundary of ligands of mono- or polydental complexants; preparing a complex composition based on a tungsten oxide $WO_3$ or a phosphorous tungstic acid, such as $H_3[P(W_3O_{10})_4]$, as well as on the use of tungsten compounds for improving anti-corrosive properties of the deposited films; mixing the aforementioned solutions of salts of Co, Ni, or W and maintaining a temperature of the mixed solution within the range of 20° C. to 100° C.; and carrying out deposition from the obtained mixed solution.

The deposited films may include $Co_{0.9}W_{0.02}P_{0.08}$, $Co_{0.9}P_{0.1}$, $Co_{0.96}W_{0.04}B_{0.001}$, $Co_{0.96}W_{0.0436}$, $B_{0.004}$, $C_{0.9}Mo_{0.02}P_{0.08}$, or other compounds suitable, e.g., for the formation of barrier layers for copper interconnects in integrated circuits of semiconductor devices. In some embodiments, the film deposited from the deposition solution described herein may include a cobalt tungsten phosphorous alloy film having a phosphorous content of approximately 2% to approximately 14% and a tungsten content of approximately 0.5% to approximately 5%.

DETAILED DESCRIPTION OF THE INVENTION

According to the invention, electroless plating is carried out in special electroless deposition apparatus disclosed in our earlier U.S. patent application Ser. No. 10/103,015 filed on Mar. 22, 2002. The process is performed by conducting autocatalytic oxidation-reduction reactions on the surface of a semiconductor substrate for deposition of pure metals, such as nickel, cobalt, tungsten, molybdenum, as well as of their accompanying elements such as phosphorus, and/or boron.

Given below is a description of the alkali-free electroless-deposition solution of the present invention. This solution contains no ammonia, and is suitable to deposit an alkali-metal-free layer on various substrates such as noble metals, noble metal activated metals as well as on nickel, cobalt, or copper.

More specifically, the alkali-metal-free deposition solution of the invention may consist of the following components: (i) a metal ion source which can be practically any soluble cobalt (II) salt; (ii) a quaternary ammonium hydroxide to adjust the pH of the solution; (iii) a reducing agent, which reduces the metal ions in the solution into metals layer on the substrate surface; (iv) one or more complexing agents, which keep the metal ions in the solution; (v) a secondary-element source, which improves the corrosion resistance of the layer; and (vi) buffering agent if needed.

Each of the components listed above will be further considered in more detail.

(i) Metal ion source, which can be practically any soluble cobalt (II) salt. Some examples are cobalt sulfate and cobalt chloride. The use of high purity cobalt (II) hydroxide would be even more advisable. This compound is sparingly soluble in water but easily dissolves in presence of complexing agents or acids. With the application of metal hydroxides instead of the commonly used soluble metal salts such as metal sulfate, chloride or nitrate salts the contamination level in the electroless deposited layer can be further minimized. Specifically, the use of sulfate, chloride, or nitrate salts introduces unwanted anions (sulfate, chloride, nitrate) into the bath and undesirably into the deposited layer. It is noted that even though the metal ion can be added as a metal salt of the complexing agent, this option is not recommended since the replenishment of metal would result in the unwanted elevation of complexing agent concentration. It is noted that for the satisfactory operation of the bath, cobalt (II) hydroxide has to be free-from cobalt (III) ions/hydroxides/oxides since cobalt (III) oxide forms unwanted colloids in the solution which later aggregates and precipitates out from the bulk solutions. Therefore, in the present invention we gave an example using cobalt sulfate as a metal source but also propose use of cobalt hydroxide as source of metal ion.

(ii) Tetra-ammonium hydroxide to adjust the pH of the solution. Tetramethylammonium hydroxide, tetraethylammonium hydroxide, tetrapropylammonium hydroxide, tetrabutylammonium hydroxide, methyltriethylammonium hydroxide, ethyltrimethylammonium hydroxide, benzyltrimethylammonium hydroxide, or any other longer alkyl chain ammonium hydroxides are adequate for maintaining the solution pH, such as phenyltrimethylammonium hydroxide or methodltripropylammonium hydroxide. In addition, the quarternary ammonium hydroxide used in the electroless deposition solution described herein may include any compound of formula $R_1R_2R_3R_4NOH$.

where $R_1$, $R_2$, $R_3$, and $R_4$ may be the same or different and may be represented by alkyl, aryl, or alkylaryl groups. In general, alkyl groups may be represented by the formula $C_2H_{2n+1}$. As such, exemplary aryl and alkylaryl groups which may be used for the deposition solution described herein may be selected from benzyl and benzylalkyl of $C_6H_5$ and $C_6H_5—C_nH_2n+_1$, respectively. It should be noted however that in practice tetrabutyl ammonium hydroxide is generally highest applicable member of the tetralkyl ammonium hydroxide family in electroless deposition since it becomes more difficult to adjust an alkaline pH as the alkyl chain gets longer. This is because the molarity of the most concentrated solution decreases drastically as well as less and less free water will be available to dissolve the bath components in the bath. Nevertheless, the use of tetramethyl ammonium hydroxide (TMAH) is preferred over tetraethyl, tetrapropyl, tetrabutyl ammonium hydroxides since TMAH is chemically more stable at elevated temperature than the longer alkyl chain analogs.

(iii) Reducing agent, which reduces the metal ions in the solution into a metal layer on the substrate surface. The preferred reducing agent is hypophosphite, which is introduced into the bath in the form of a compound selected from the group consisting of hypophosphorous acid, an alkali-metal-free salt of hypophosphorous acid and a complex of a hypophosphoric acid. The hypophosphite serves as a source for phosphorous in the deposited layer. Another practically usable reducing agent is dimethylamine borane (DMAB), which may be used as a source of boron for the deposition layer. In fact, any alkyl, dialkyl, trialkyl amine boranes of the general formula: $R_1R_2R_3NH_{3-n}BH_3$ may be used as a reducing agent in the deposition solution described herein. In such a formula, n is the number of alkyl groups attached to said amine boranes and may generally be 0, 1, 2, or 3. In some case $R_1$, $R_2$, and $R_3$ may be the same alkyl groups. In other cases, however one or more of $R_1$, $R_2$, and $R_3$ may be different alkyl groups. In any case, another practically usable reducing agent for the deposition solution described herein is hydrozine.

(iv) One or more complexing agents, which keep the metal ions in the solution even at pH values where the metal ions otherwise would form insoluble metal hydroxide. Common applicable complexing ions are, but not limited to, citrate, tartrate, glycine, pyrophosphate, ethylene tetraacetic acid, (EDTA). The complexing agents are introduced into the bath as acids. Specifically, citrate is introduced as citric acid, tartrate as tartaric acid, or pyrophosphate as pyrophosphoric acid. In the current invention citric acid will be used as complexing agent but the use of other complexing agents or their combinations are also possible.

(v) Second metal ion source which improves the corrosion resistance of the layer. This ion is a tungsten (VI) compound generally tungsten (VI) oxide ($WO_3$) or tungsten phosphoric acid $H_3[P(W_3O_{10})_4]$, however tungsten in other oxidation states such as V or IV, are also applicable. The aforementioned second metal can be selected from the $4^{th}$ period of the periodic table, $5^{th}$ period of the periodic table, and $6^{th}$ period of the periodic table. The second metal selected from the $4^{th}$ period of the periodic table is selected from Cr, Ni, Cu, and Zn, said second metal selected from the $5^{th}$ period of the periodic table is selected from Mo, Tc, Ru, Rh, Pd, Ag, Cd, In, Sn, and Sb, and said second metal selected from the $6^{th}$ period of the periodic table is selected from W, Re, Os, Ir, Pt, Au, Tl, and Bi.

(vi) Buffering agent if needed. Most common compound to buffer solution in the pH range 8 to 10 is boric acid.

If necessary, other non-essential components can also be added to the bath in order to change properties of the deposited film, rate of deposition, solution stability, and to improve resistance to corrosion. Some of these auxiliary components and their functions are the following:

(vii) Alloying promoter, which increases a relative amount of alloying elements in the film and makes the film structure more amorphous. Such components can be represented by complexing agents which form highly stable complexes with cobalt ions. It is recommended that the complex stability of such agents exceeds $10^{10}$. These auxiliary complexing agents have to be used in amount significantly smaller than the primary complexing agents. Other auxiliary components of this group are ethylenediamine tetraacetic acid, N,N,N'-hydroxyethyleneethylenediamine triacetic acid, and other similar compounds known to those skilled in the art.

Tsuda and Ishii (U.S. Pat. No. 4,636,255) showed that the addition of N,N,N'-hydroxyethyleneethylenediamine triacetic acid in circa 4–12 mmol/l concentration could significantly increase the content of phosphorus in a nickel-phosphorous (NiP) deposit.

The applicants have also found that the addition of any inorganic phosphorous oxocompounds which contain phosphorus in oxidation states of III or V can significantly change the content of phosphorus in the deposited film in order to provide desirable properties, such as reduced stress, improved resistance to diffusion, and improved crystallinity of the film structure. Examples of these additional compounds are the following: phosphates, pyrophosphates, and tungsten phosphoric acid. For example, by using a bath containing 71.5 g/l citric acid monohydrate, 21 ml/l 50 wt. % hypophosphorous acid, 23 g/l cobalt (II) sulfate heptohydrate, 7.2 g/l tungsten (VI) oxide, 31 g/l cobalt (II) sulfate heptahydrate, 7.2 g/l tungsten (VI) oxide, 31 g/l boric acid, as well as an appropriate amount of TMAH to adjust the aqueous solution pH to 9–10.2, one can obtain a CoWP film having phosphorous content of about 10 atomic %. When citric acid is replaced with pyrophosphoric acid as a complexing agent in a 61 g/l concentration, the phosphorous concentration of the film changes from 10 atomic % to 2 atomic %.

(viii) Corrosion inhibitor for substrates, e.g., copper substrates. In order to minimize corrosion of copper in the initial period of deposition, a corrosion inhibitor can be added to the deposition solution. However, these compounds should be added in an the amount not detrimental to the purposes of the present invention. Examples of such corrosion inhibitors are the following: inorganic phosphates, silicates, and long-chain alkyl phosphonic acids, though other compounds can also be used and are known to those skilled in the art.

(ix) Surface-active agents. These agents can be added to the bath in order to reduce surface roughness or to modify grain size in the deposited film. Anionic and/or nonionic surface-active agents are preferable, since cationic agents may significantly hamper the deposition.

(x) Accelerator. In order to alter the rate of deposition without changing the composition of the film, a deposition accelerator can be added to the solution. One such accelerator is a boric acid, though other compounds known in the art can also be used.

For capping/passivation layer on copper or as a barrier layer for copper one requires a CoWP thickness of 50–300 Angstrom. Thicker film adversely affects the line resistance while thinner CoWP layer may not be enough for the film to function as a passivation or a barrier layer. Furthermore, the solution should provide a continuous, smooth film and the COWP layer should not contain any pinholes, since these sites can be preferential sites for copper diffusion.

In order to achieve a smoother deposit without using additives the mole ratio of citrate to cobalt should be more than 4 and preferably more than 5 and the pH should be above 9.2 and preferably around 10. The mole ratio of cobalt plus tungsten to hypophosphite should be between 0.4 and 0.90, preferably between 0.45 and 0.85 when tungsten (VI) oxide is used as the source of tungsten. When tungsten phosphoric acid used as the tungsten source the cobalt plus tungsten to hypophosphite ratio should be between 1.2 and 2.6, preferably around 1.68. Further improvement in surface smoothness can be achieved by adding polypropylene glycol to the solution in 0.01–0.1 g/l into the solution. While polypropylene glycols with an average molecular weight of up to 10,000 were tested and all of them exhibited improvement on the film quality, the preferred molecular weight was found to be from 400 to 1000 Mw.

Having described the components of the alkali-metal-free electroless deposition solution of the invention, let us consider the steps of the method of the invention based on the use of the aforementioned solution.

The method of the invention comprises three steps, which are described below in more detail. All these steps occur simultaneously.

Hydroxides of a bivalent cobalt [$Co(OH)_2$, $Ni(OH)_2$] are slightly-dissociated bases and therefore they are poorly soluble in water. In a general form, a reaction of hydroxides with water can be represented as follows:

$$Co(OH)_2 \rightleftharpoons Co\,OH^+ + OH^- \quad (1)$$

$$Ni(OH)_2 \rightleftharpoons Ni\,OH^+ + OH^- \quad (2)$$

Solubility of these compounds in water is much lower than 0.01%. Therefore, it has been known to those skilled in the art to prepare aqueous solutions from salts of the aforementioned metals, such as $CoSO_4$ and $CoCl_2$, rather from their hydroxides. However, the aforementioned salts leads to undesired increase in the contents of anions, such as $SO_4^{2-}$, $Cal^-$, $NO_3^-$, etc., which impair the properties of the deposited films, in particular, resistance of the metal films to corrosion.

Step 1

The authors have found that the aforementioned problems can be solved by dissolving metal hydroxides in the solutions of complexing agents, in which solutions of hydroxides of Ni and Co are obtained by displacing hydroxyl ions $OH^-$ beyond the external boundary of ligands of mono- or polydental complexants $$Co(OH)_2 + 2C_6O_7H_8 \rightleftharpoons [Co(C_6O_7H_7)_2] + H_2O + OH^- \quad (3)$$

$$Co(OH)_2 + EDTA \rightleftharpoons [Co(EDTA)] + 2H_2O, \quad (4)$$

where EDTA is ethylenediaminetetraacetic acid. Cobalt and nickel hydrides are known to be unstable in acidic solutions. Therefore the use of complexing agents as their acids can accelerate dissolving.

Reactions (3) and (4) comprise the first step in the process of the invention and determine the aforementioned autocatalytic process of deposition of metals and phosphorus into films.

As has been mentioned above, one of the problems associated with selection of components of the working media for electroless deposition is that a tungsten oxide, which has to be used in the process, is practically insoluble in water and acids and therefore cannot be converted directly into an acid, i.e., via a direct reaction with water. However, tungsten trioxides may be converted to soluble tungstate ions, if they are dissolved in highly alkaline solution. This particular property of trioxides was used by the applicants for achieving one of the objects of the invention. The compounds used by applicants for these purposes comprised alkylammonium hydroxides, such as tetramethylammonium hydroxide $(CH_4)_4NOH$ (hereinafter referred to as TMAH), tetraethylammonium hydroxide $(C_2H_5)_4NOH$ (hereinafter referred to as TEAOH), tetrabutylammonium hydroxide $(C_4H_9)_4NOH$ (hereinafter referred to as TBAOH), tetrapropylammonium hydroxide (hereinafter referred to as TPA), methyltriethylammonium hydroxide $(CH_4)(C_2H_5)_3NOH$ (hereinafter referred to as MTEOH), ethyltrimethylammonium hydroxide $(CH_4)_3(C_2H_5)_3NOH$ (hereinafter referred to as ETMOH), benzyltrimethylammonium hydroxide $(C_6H_5)CH_2(CH_4)_3NOH$ (hereinafter referred to as Triton B), phenyltrimethylammonium hydroxide, methyltripropylammonium hydroxide, and a compound that includes a molecular chain of butyl radicals, such as $(C_4M_9—(CH_4H_7)_n—C_4H_9).4NOH$, which is also known as tetrabutylammonium hydroxide. In addition, the electroless deposition solution described herein may include any compound of formula $R_1R_2R_3R_4NOH$, where $R_1$, $R_2$, $R_3$, $R_4$ may be the same or different and may be represented by alkyl, aryl, or alkylaryl groups. In general, alkyl groups may be represented by the formula $C_2H_{2n+1}$. As such, exemplary aryl and alkylaryl groups which may be used for the deposition solution described herein may be selected from benzyl and benzylalkyl of $C_6H_5$ and $C_6H_5—C_nH_2n+_1$, respectively.

Step 2

The second step of the process consists of preparing a complex composition based on a tungsten oxide $WO_3$, phosphorous tungstic acid, such as $H_3[P(W_3O_{10})_4]$, or tungstic acid, as well as on the use of tungsten compounds with other degrees of oxidation. The presence of tungsten significantly improves anti-corrosive properties of the deposited films. However, the invention excludes the use of alkali-metal salts of tungstic acid, such as $Na_2WO_4$, since these salts are easily hydrolysable with the formation of $Na_2WO_4.2H_2O$ and are easily soluble in water. This is because the presence of sodium in the deposition solution to some extent limits formation of metal films of high purity required for use in semiconductor industry.

As has been mentioned above, one of the problems associated with selection of components of the working media for electroless deposition is that a tungsten oxide, which has to be used in the process, is practically insoluble in water and acids and therefore cannot be converted directly into an acid, i.e., via a direct reaction with water. However, tungsten trioxides may be converted to soluble tungstate ions, if they are dissolved in highly alkaline solution. This particular property of trioxides was used by the applicants for achieving one of the objects of the invention. The compounds used by applicants for these purposes comprised alkylammonium hydroxides, such as tetramethylammonium hydroxide $(CH_4)_4NOH$ (hereinafter referred to as TMAH), tetraethylammonium hydroxide $(C_2H_5)_4NOH$ (hereinafter referred to as TEAOH), tetrabutylammonium hydroxide $(C_4H_9)_4NOH$ (hereinafter referred to as TBAOH), tetrapropylammonium hydroxide (hereinafter referred to as TPA), methyltriethylammonium hydroxide $(CH_4)(C_2H_5)_3NOH$ (hereinafter referred to as MTEOH), ethyltrimethylammonium hydroxide $(CH_4)_3(C_2H_5)NOH$ (hereinafter referred to as ETMOH), benzyltrimethylammonium hydroxide $(C_6H_5)CH_2(CH_4)_3NOH$ (hereinafter referred to as Triton B), phenyltrimethylammonium hydroxide, methyltripropylammonium hydroxide, and a compound that includes a molecular chain of butyl radicals, such as tetrabutylammonium hydroxide $(C_4M_9—(CH_4H_7)_n—C_4H_9).4NOH$, which is also known as tetrabutylammonium hydroxide.

The use of TMAH is less desirable in view of its high volatility and toxicity.

It is more preferable to use ethyl-, propyl-, and butylammonium hydroxides which are less volatile and toxic.

In the aforementioned compounds, alkyl radicals should have optimal mobility required for maintaining pH of the medium. The applicants have found that such compounds as TBAOH, TEAOH, and TPA may satisfy the requirement of radical mobility, and at the same time do not create obstacles for formation of water-soluble complexes with tungsten trioxides. Heavier alkyls, beginning from pentyls, decrease solubility of the complexes in water. The applicants assume that this phenomenon is associated with electron-density screening which is higher in alkyls of larger dimensions.

Step 3

In the third step, for deposition of coating films, the aforementioned solutions of salts of Co, Ni, or W are mixed and maintained under a temperature within the range of 20° C. to 100° C. The deposited films may include, e.g., $Co_{0.9}W_{0.02}P_{0.08}$, $Co_{0.9}P_{0.1}$, $Co_{0.96}W_{0.04}B_{0.001}$, $Co_{0.96}W_{0.0436}$, $B_{0.004}$, $C_{0.9}Mo_{0.03}P_{0.08}$ or other compounds suitable, e.g., for the formation of barrier layers for copper interconnects in integrated circuits of semiconductor devices.

The invention will be further described with reference to Practical Examples. In the following examples, the content of elements in the coating films was obtained by means of an ion microprobe known as SIMS (Secondary Ion Mass Spectrometry technique), in which a high energy primary ion beam is directed at an area of the sample whose composition is to be determined. The values obtained by the SIMS method will be given in atomic percents.

PRACTICAL EXAMPLE 1

Five deposition solutions, each having a volume of 1 liter, were prepared by mixing the following components with an increase in the content of each component: 50 g to 100 g of citric acid monohydrate $(C_6O_7H_8xH_2O)$ with 10 g difference between the subsequent solutions; 15 ml to 27 ml of a 50 wt. % hypophosphorous acid $(H_3PO_2)$ with 3 ml difference between the subsequent hypophosphorous acids; 18 g to 26 g of cobalt sulfate heptahydrate $(CoSO_4x7H_2O)$ with 2 g difference between subsequent cobalt sulfate heptahydrates; 24 g to 36 g of boric acid $(H_3BO_3$ with 3 g difference between the subsequent boric acids; 11 g to 16 g of tungsten (VI) oxide $(WO_3)$ with 1.5 g difference between the subsequent; and an appropriate amount of TMAH for each solution required to reach an appropriate alkaline pH. The deposition was performed at a bath temperature of 75° C. The deposition rates were within the range of 180 to 220 Angstrom/min. The composition of the obtained coating film was determined with the use of SIMS showed that the film contained 5–6 atomic % phosphorous, 7.0–7.5 atomic % tungsten, and cobalt as balance. Furthermore, the results of the SIMS analysis showed that the content of Na and K did not exceed $2\times10^{-4}$ atomic % (2 ppm).

Analysis showed that films deposited from the electroless deposition solution prepared in Practical Example 1 had high anti-corrosive properties.

PRACTICAL EXAMPLE 2

Five deposition solutions, each having a volume of 1 liter, were prepared by mixing the following components with an increase in the content of each component: 50 g to 90 g of citric acid monohydrate ($C_6O_7H_8xH_2O$) with 10 g difference between the subsequent solutions; 15 ml to 27 ml of a 50 wt. % hypophosphorous acid ($H_3PO_2$) with 3 ml difference between the subsequent hypophosphorous acids; 18 g to 26 g of cobalt sulfate heptahydrate ($CoSO_4x7H_2O$) with 2 g difference between subsequent cobalt sulfate heptahydrates; 24 g to 36 g of boric acid ($H_3BO_3$ with 3 g difference between the subsequent boric acids; 11 g to 16 g of tungsten (VI) oxide ($WO_3$) with 1.5 g difference between the subsequent; and an appropriate amount of TBAOH for each solution required to reach an appropriate alkaline pH of 9.3 to 9.7. The deposition was performed at a bath temperature of 75° C. The deposition rates were within the range of 220 to 260 Angstrom/min. The composition of the obtained coating film was determined with the use of SIMS showed that the film contained 6.5 to 7.5 atomic % phosphorous, 3.5 to 4.0 atomic % tungsten, and cobalt as balance. Furthermore, the results of the SIMS analysis showed that the content of Na and K did not exceed $2\times10^{-4}$ atomic % (2 ppm).

It can also be seen that the electroless deposition solution prepared in Practical Example 2 possessed lower toxicity than a majority of the known deposition solutions.

PRACTICAL EXAMPLE 3

Five deposition solutions, each having a volume of 1 liter, were prepared by mixing the following components with an increase in the content of each component: 50 g to 90 g of citric acid monohydrate ($C_6O_7H_8xH_2O$) with 10 g difference between the subsequent solutions; 15 ml to 27 ml of a 50 wt. % hypophosphorous acid ($H_3PO_2$) with 3 ml difference between the subsequent hypophosphorous acids; 18 g to 26 g of cobalt sulfate heptahydrate ($CoSO_4x7H_2O$) with 2 g difference between subsequent cobalt sulfate heptahydrates; 24 g to 36 g of boric acid ($H_3BO_3$ with 3 g difference between the subsequent boric acids; 11 g to 16 g of tungsten (VI) oxide ($WO_3$) with 1.5 g difference between the subsequent; and an appropriate amount of TEAOH for each solution required to reach an appropriate alkaline pH of 9.3 to 9.7. The deposition was performed at a bath temperature of 75° C. The rates of deposition were within the range of 80 to 140 Angstrom/min. The composition of the obtained coating film was determined with the use of SIMS showed that the film contained 9.5 to 10.0 atomic % phosphorous, 0.5 to 1.0 atomic % tungsten, and cobalt as balance. Furthermore, the results of the SIMS analysis showed that the content of Na and K did not exceed $2\times10^{-4}$ atomic % (2 ppm).

Analysis showed that, along with a reduced toxicity of the solution and high anti-corrosive properties of the deposited films, the deposited films has a very low concentration of metals prone to oxidation.

PRACTICAL EXAMPLE 4

Five deposition solutions, each having a volume of 1 liter, were prepared by mixing the following components with an increase in the content of each component: 60 g to 100 g of citric acid monohydrate ($C_6O_7H_8xH_2O$) with 10 g difference between the subsequent solutions; 30 ml to 42 ml of a 50 wt. % hypophosphorous acid ($H_3PO_2$) with 3 ml difference between the subsequent hypophosphorous acids; 16 g to 24 g of cobalt sulfate heptahydrate ($CoSO_4x7H_2O$) with 2 g difference between subsequent cobalt sulfate heptahydrates; 9.5 g to 14.5 g of tungsten (VI) oxide ($WO_3$) with 1.5 g difference between the subsequent; and an appropriate amount of TPA for each solution required to reach an appropriate alkaline pH of 10.1 to 10.5. The deposition was performed for each solution at three different bath temperatures of 55° C., 65° C., and 75° C. The rates of deposition were within the range of 90 to 260 Angstrom/min. The composition of the obtained coating film was determined with the use of SIMS showed that the film contained 6.5 to 7.5 atomic % phosphorous, 3.5 to 4.0 atomic % tungsten, and cobalt as balance. Furthermore, the results of the SIMS analysis showed that the content of Na and K did not exceed $2\times10^{-4}$ atomic % (2 ppm).

Improved properties of the obtained films showed that complexing agents had optimal concentrations in the deposition solution.

Thus it has been shown that the invention provides an alkali-metal-free solution for electroless deposition, makes it possible to reduce the amount of highly-volatile, contaminating, and toxic components in an electroless deposition solution, provides aforementioned solutions with reduced toxicity, improves anti-corrosive properties of the deposited films, minimizes the amount of ions of precipitation metals with a high degree of oxidation, excludes or minimizes the use of solutions, which have a tendency to the formation of gels and various other colloidal aggregates that may impair properties of deposited metal films, makes it possible to use complexing agents in optimal concentrations which improve quality of the deposited films, allows to form smooth coating films which are free of alkali-metal components, provides aforementioned coating films suitable for formation of barrier/capping layers on semiconductor substrates, and provides a method for forming alkali-metal-free coating films and for manufacturing IC devices at a reduced cost.

The invention has been shown and described with reference to specific embodiments, which should be construed only as examples and do not limit the scope of practical applications of the invention. Therefore any changes and modifications in technological processes, components and their concentrations in the solutions are possible, provided these changes and modifications do not depart from the scope of the patent claims.

What is claimed is:

1. An electroless deposition solution for forming an alkali-metal-free coating on a substrate, said electroless desposition solution comprising:

ions of a first metal;

a pH adjuster in the form of a quaternary ammonium hydroxide for adjusting the pH of said solution;

a reducing agent, which reduces said first-metal ions into a first layer of said alkali-metal-free coating on said substrate;

at least one complexing agent comprising an inorganic phosphorous oxocompound for keeping said first-metal ions in said electroless deposition solution prior to being reduced into the first layer; and ions of a second metal distinct from the first metal, that improve the corrosion resistance of said alkali-metal-free coating.

2. The electroless deposition solution of claim 1, wherein said first metal comprises cobalt.

3. The electroless deposition solution of claim 1, wherein said first metal comprises nickel.

4. The electroless deposition solution of claim 1, wherein said quaternary-ammonium hydroxide is selected from the group consisting of: tetramethylammonium hydroxide, tetraethylammonium hydroxide, tetrapropylammonium hydroxide, tetrabutylammonium hydroxide, methyltriethylammonium hydroxide, ethyltrimethylammonium hydroxide, benzyltrimethylammonium hydroxide, phenyltrimethylammonium hydroxide, methyltripropylammonium hydroxide, and any compound of formula $R_1R_2R_3R_4NOH$, where $R_1$, $R_2$, $R_3$ and $R_4$ comprise the same or different alkyl, aryl, or alkylaryl groups, where said alkyl groups comprise the general formula $C_nH_{2n+1}$, and where aryl and alkylaryl groups comprise benzyl and benzylalkyl of $C_6H_5$ and $C_6H_5$—$C_nH_2n+_1$, respectively.

5. The electroless deposition solution of claim 1, wherein said quaternary-ammonium hydroxide is selected from the group consisting of: tetramethylammonium hydroxide, tetraethylammonium hydroxide, tetrapropylammonium hydroxide, and tetrabutylammonium hydroxide.

6. The electroless deposition solution of claim 1, wherein said reducing agent is selected from the group consisting of alkyl, dialkyl and trialkyl amine boranes of the general formula: $R_1R_2R_3NH_{3-n}BH_3$, where $R_1$, $R_2$, and $R_3$ comprise the same or different alkyl groups and n is the number of alkyl groups attached to said amine boranes, where n can be 0, 1, 2, and 3 methyl.

7. The electroless deposition solution of claim 1, wherein said reducing agent is selected from the group consisting of hypophosphite, hydrazine, dimethylamine borane.

8. The electroless deposition solution of claim 7, wherein said hypophosphite comprises a source of phosphorous for said alkali-metal free coating and is introduced into said solution in the form of a compound selected from the group consisting of hypophosphorous acid, an alkali-metal-free salt of hypophosphorous acid, and a complex of a hypophosphoric acid.

9. The electroless deposition solution of claim 1, wherein said at least one complexing agent comprises pyrophosphate.

10. The electroless deposition solution of claim 9, wherein said pyrophosphate is introduced into said electroless deposition solution as pyrophosphoric acid.

11. The electroless deposition solution of claim 1, wherein said second metal comprises tungsten.

12. The electroless deposition solution of claim 1, wherein said second metal is selected from the group consisting of the $4^{th}$ period of the periodic table, $5^{th}$ period of the periodic table, and $6^{th}$ period of the periodic table.

13. The electroless deposition solution of claim 12, wherein said second metal selected from the $4^{th}$ period of the periodic table is selected from the group consisting of Cr, Ni, Cu, and Zn, said second metal selected from the $5^{th}$ period of the periodic table is selected from the group consisting of Mo, Tc, Ru, Rh, Pd, Ag, Cd, In, Sn, and Sb, and said second metal selected from the $6^{th}$ period of the periodic table is selected from the group consisting of W, Re, Os, Ir, Pt, Au, Tl, and Bi.

14. The electroless deposition solution of claim 1, further comprising a buffering agent.

15. The electroless deposition solution of claim 14, wherein said buffering agent is a boric acid solution for maintaining pH of said electroless deposition solution within the range of 8 to 10.

16. The electroless deposition solution of claim 1, wherein said alkali-metal-free coating is a cobalt tungsten phosphorous alloy film having a phosphorous content of 2% to 14% and a tungsten content of 0.5% to 5%, said electroless deposition solution comprising: cobalt ions, tungsten ions, a hypophosphite reducing agent for said cobalt and tungsten ions, and a pH adjustor.

17. The electroless deposition solution of claim 1, wherein said alkali-metal-free coating comprises a barrier layer for the formation of copper interconnects in integrated circuits of semiconductor devices and is formed from a material selected from the group consisting of $Co_{0.9}W_{0.02}P_{0.08}$, $Co_{0.9}P_{0.1}$, $Co_{0.96}W_{0.0436}$, $B_{0.004}$, $C_{0.9}Mo_{0.03}P_{0.08}$.

18. A method for preparing an electroless deposition solution, comprising dissolving a metal hydroxide in an acidic complexing agent to generate ions of a first metal.

19. The method of claim 18, wherein the step of dissolving the metal hydroxide comprises dissolving cobalt hydroxide in an acidic complexing agent.

20. The method of claim 19, wherein the cobalt hydroxide is substantially absent of cobalt (III) compounds.

21. The method of claim 19, wherein the step of dissolving the cobalt hydroxide comprises dissolving the cobalt hydroxide in a citric acid salt solution to produce a molar ratio of citrate to cobalt greater than approximately 4.0.

22. The method of claim 18, wherein the step of dissolving the metal hydroxide comprises dissolving nickel hydroxide in an acidic complexing agent.

23. The method of claim 18, wherein the step of dissolving the metal hydroxide comprises dissolving the metal hydroxide in a citric acid solution substantially absent of sodium and ammonia.

24. The method of claim 18, wherein the step of dissolving the metal hydroxide comprises dissolving the metal hydroxide in ethylenediaminetetraacetic acid.

25. The method of claim 18, wherein the step of dissolving the metal hydroxide comprises dissolving the metal hydroxide in a citric acid solution substantially absent of sodium and ammonia.

26. The method of claim 18, further comprising mixing a compound comprising tungsten with the metal hydroxide and acidic complexing agent.

27. The method of claim 26, wherein the compound comprises phosphorous tungstic acid or tungstic acid.

28. The method of claim 26, wherein the compound comprises tungsten oxide.

29. The method of claim 28, further comprising adding an alkylammonin hydroxide with the tungsten oxide.

30. The method of claim 29, wherein the alkylammonium hydroxide solution comprises an alkylammonium hydroxide heavier than tetramethylammonium hydroxide.

31. The method of claim 30, wherein the alkylammonium hydroxide solution is selected from a group consisting of tetraethylammonium hydroxide, tetrapropylammonium hydroxide, and tetrabutylammonium hydroxide.

32. A method for preparing an electroless deposition solution, comprising dissolving tungsten oxide in a solution comprising an alkylammonium hydroxide heavier than tetramethylammonium hydroxide to produce tungsten ions.

33. The method of claim 32, wherein the alkylammonium hydroxide is selected from a group consisting of tetramethylammonium hydroxide, tetrapropylammonium hydroxide, and tetrabutylammonium hydroxide.

34. The method of claim 32, further comprising mixing a metal ion source distinct from the tungsten oxide, a reducing agent and at least one complexing agent in the solution comprising an alkylammonium hydroxide heavier than tetramethylammonium hydroxide.

35. The method of claim 34, wherein the step of mixing the metal ion source within the solution comprises dissolving a metal ion source substantially free of alkali metals.

36. The method of claim 34, wherein the steps of mixing the metal ion source and the complexing agent within the solution comprises dissolving the metal hydroxide within the complexing agent to produce metal ions distinct from the tungsten ions.

37. The method of claim 34, wherein the step of mixing the metal ion source within the solution comprises dissolving metal salts within the solution.

38. The method of claim 34, wherein the step of mixing the complexing agent within the solution comprises mixing an inorganic phosphorus oxocompound within the solution.

39. The method of claim 34, wherein the step of mixing the complexing agent within the solution comprises mixing ethylenediaminetetraacetic acid within the solution.

40. The method of claim 34, wherein the step of mixing the reducing agent within the solution comprises mixing a component selected from the group consisting of hypophosphite, hydrazine, and dimethylamine borane.

41. The method of claim 40, wherein the step of mixing the metal ion source within the solution comprises mixing a cobalt compound within the solution such that a molar ratio of cobalt and tungsten to hypophosphite is between approximately 0.4 and approximately 0.9.

42. The method of claim 32, further comprising mixing polypropylene glycol within the solution comprising an alkylammonium hydroxide heavier than tetramethylammonium hydroxide.

43. The method of claim 32, wherein the step of mixing the polypropylene glycol within the solution comprises adding between approximately 0.01 g/L and approximately 0.1 g/L of polypropylene glycol.

* * * * *

UNITED STATES PATENT AND TRADEMARK OFFICE

CERTIFICATE OF CORRECTION

PATENT NO. : 6,911,067 B2
DATED : June 28, 2005
INVENTOR(S) : Kolics et al.

It is certified that error appears in the above-identified patent and that said Letters Patent is hereby corrected as shown below:

Column 12,
Line 57, delete the comma "," between the words "metal" and "that".

Column 13,
Line 10, delete "$C_nH_2n+_1$" and substitute -- $C_nH_{2n+1}$ --.
Line 22, delete "methyl" after "3".

Column 14,
Line 3, delete "$Co_{0.96}W_{0.0436}$, $B_{0.004}$" and substitute -- $Co_{0.96}W_{0.0436}B_{0.004}$ --.
Line 4, delete "$C_{0.9}Mo_{0.03}P_{0.08}$" and substitute -- $C_{0.9}Mo_{0.02}P_{0.08}$ --.

Signed and Sealed this

Twenty-first Day of February, 2006

JON W. DUDAS
*Director of the United States Patent and Trademark Office*